US006116619A

United States Patent [19]

Kao et al.

[11] Patent Number: 6,116,619

[45] Date of Patent: Sep. 12, 2000

[54] SOLE PLATE STRUCTURE WITH SHOCK ABSORBING EFFECTS FOR ROLLER SKATES

[76] Inventors: Chuan-Fu Kao; Chi-Chun Chiu, both of P.O. Box 82-144, Taipei, Taiwan

[21] Appl. No.: 09/012,582

[22] Filed: Jan. 26, 1998

[51] Int. Cl.[7] ..... A63C 17/00

[52] U.S. Cl. ..... 280/11.19; 280/11.28

[58] Field of Search ..... 280/842, 11.19, 280/11.22, 11.27, 11.28, 11.23

[56] References Cited

U.S. PATENT DOCUMENTS 5,931,480 8/1999 Schroeder ..... 280/11.28

*Primary Examiner*—J. J. Swann
*Assistant Examiner*—Kevin McKinley
*Attorney, Agent, or Firm*—A & J

[57] ABSTRACT

A sole plate structure with shock absorbing effects for roller skates to provide roller skates with buffering resilience and permit safe and comfortable skating, includes two opposed side plates having an upper edge secured to the bottom side of a boot. Movable supports are secured to the rear ends of the side plates and are connected to a wheel by means of a securing shaft. The movable shafts are capable of upward and downward displacement. The front ends of the movable supports are connected to a rear shaft hole of a spring. The spring has a front shaft hole secured to a front threaded shaft secured to the front ends of the side plates.

1 Claim, 6 Drawing Sheets

SOLE PLATE STRUCTURE WITH SHOCK ABSORBING EFFECTS FOR ROLLER SKATES

BACKGROUND OF THE INVENTION

1. Field of the Invention

The present invention relates generally to a sole plate structure with shock absorbing effects for roller skates, and more particularly to a sole plate structure including two opposed side plates, movable supports disposed between the side plates at their rear ends, the movable supports being connected to a wheel, and a spring having a rear end connected to the front ends of the movable supports and a front end connected to a threaded shaft secured at the front end of the side plates.

2. Description of the Prior Art

Reference is made to FIG. 1, which shows a conventional sole plate for roller skates. It essentially comprises side plates 4 disposed below a boot 1 and an array of in-line wheels 5 secured between the side plates 4. During roller skating, the skater will often lift the legs or jump, or skate over rugged surfaces. In conventional roller skates, the impact or shock when the roller skates hit the ground surface during these actions cannot be evenly distributed so that it is directly borne by the ankles and feet of the skater, which may lead to foot injuries. Besides, as there is no shock absorbing means disposed between the side plates 4 and the wheels 5, it is not comfortable to skate. These problems are long felt in the art. A sole plate structure that has shock absorbing effects is therefore desirable.

SUMMARY OF THE INVENTION

A primary object of the present invention is to provide a sole plate structure with shock absorbing effects for roller skates so that skating is made comfortable and the skater will not get foot injuries during skating.

In order to achieve the above-mentioned object, a sole plate structure comprises two opposed side plates with wheels disposed therebetween, movable supports secured at the rear end of the side plates and connected to one of the wheels, and a spring having a rear end connected to the front ends of the movable supports and a front end connected to a threaded shaft secured at the front ends of the side plates.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
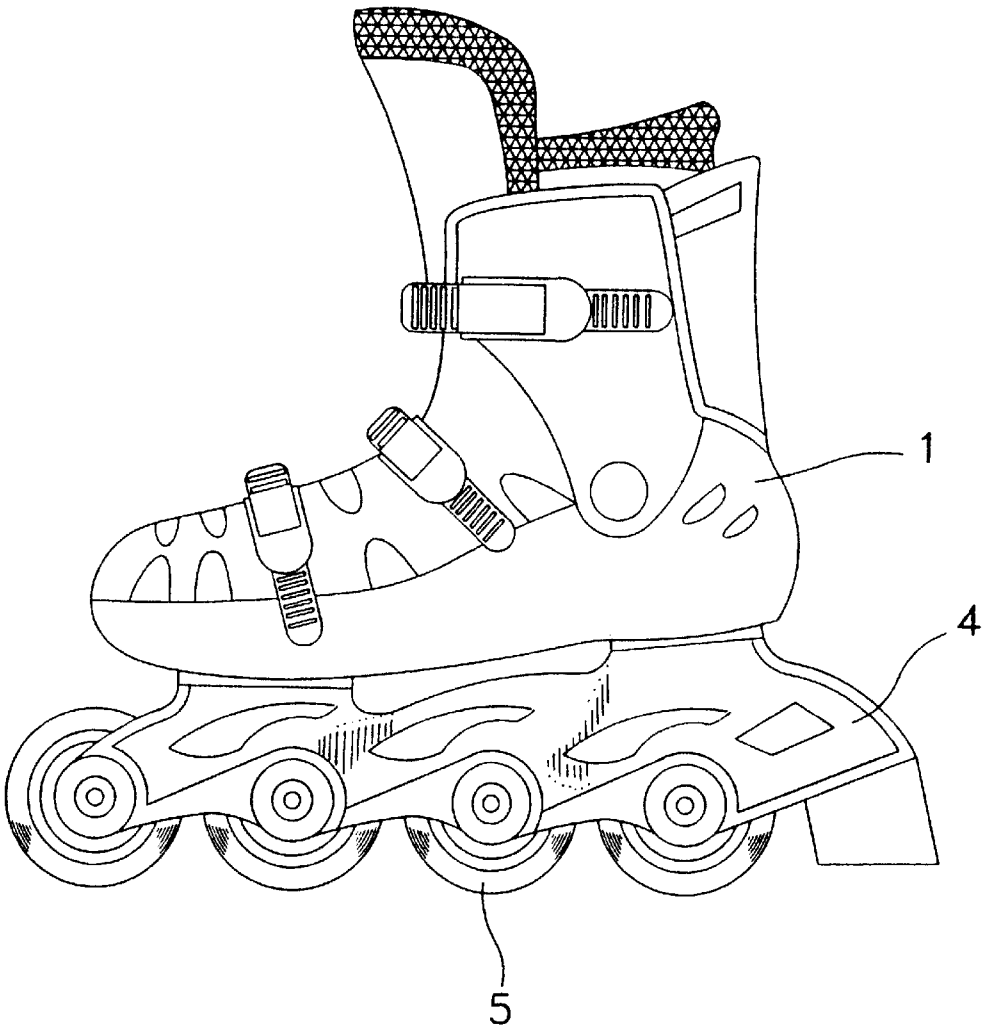
PRIOR ART FIG. 1
FIG. 1 is a side view of a conventional roller skate.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
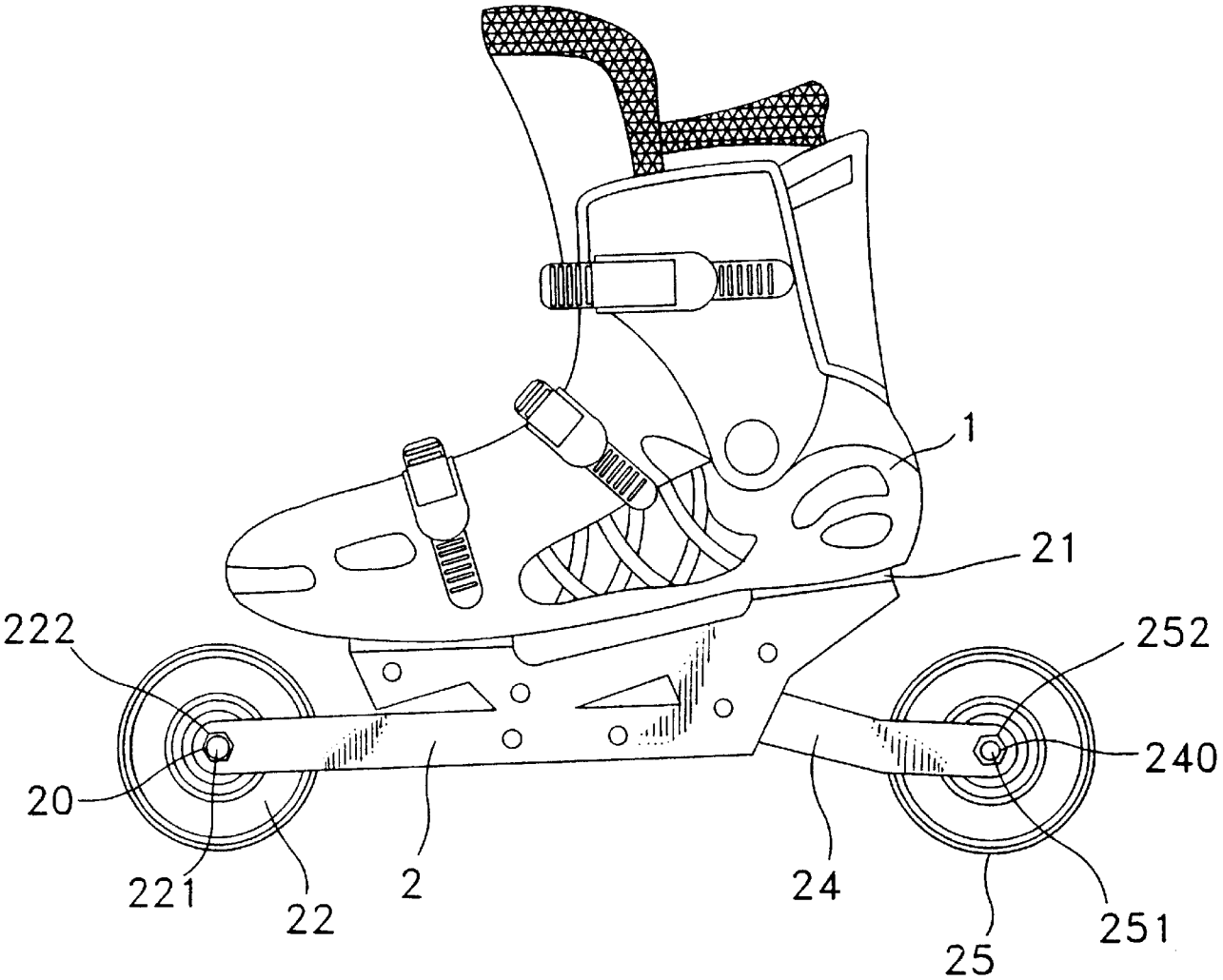
FIG. 2 is a side view of the present invention.
Figure 3:
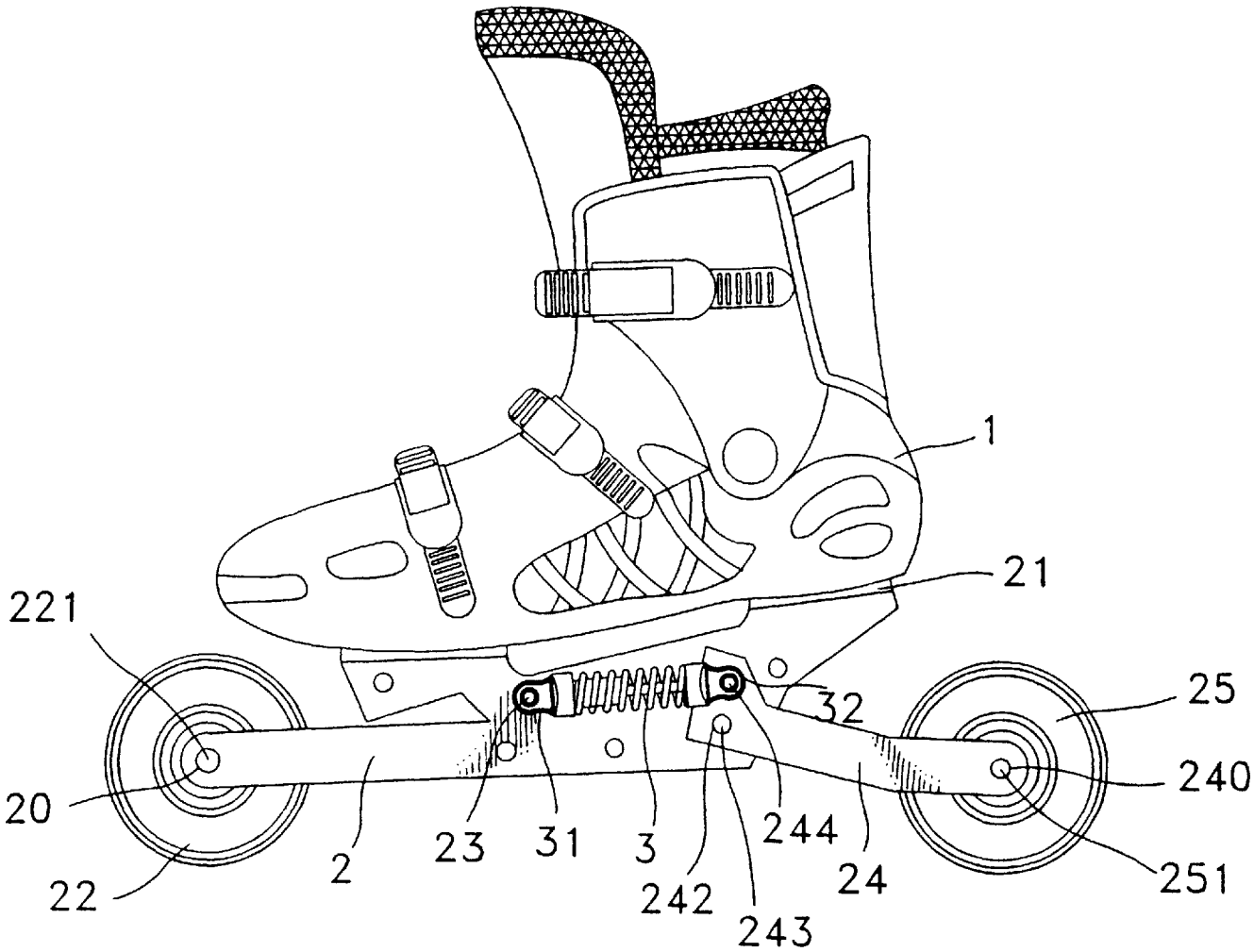
FIG. 3 is a side sectional view of the present invention.
Figure 4:
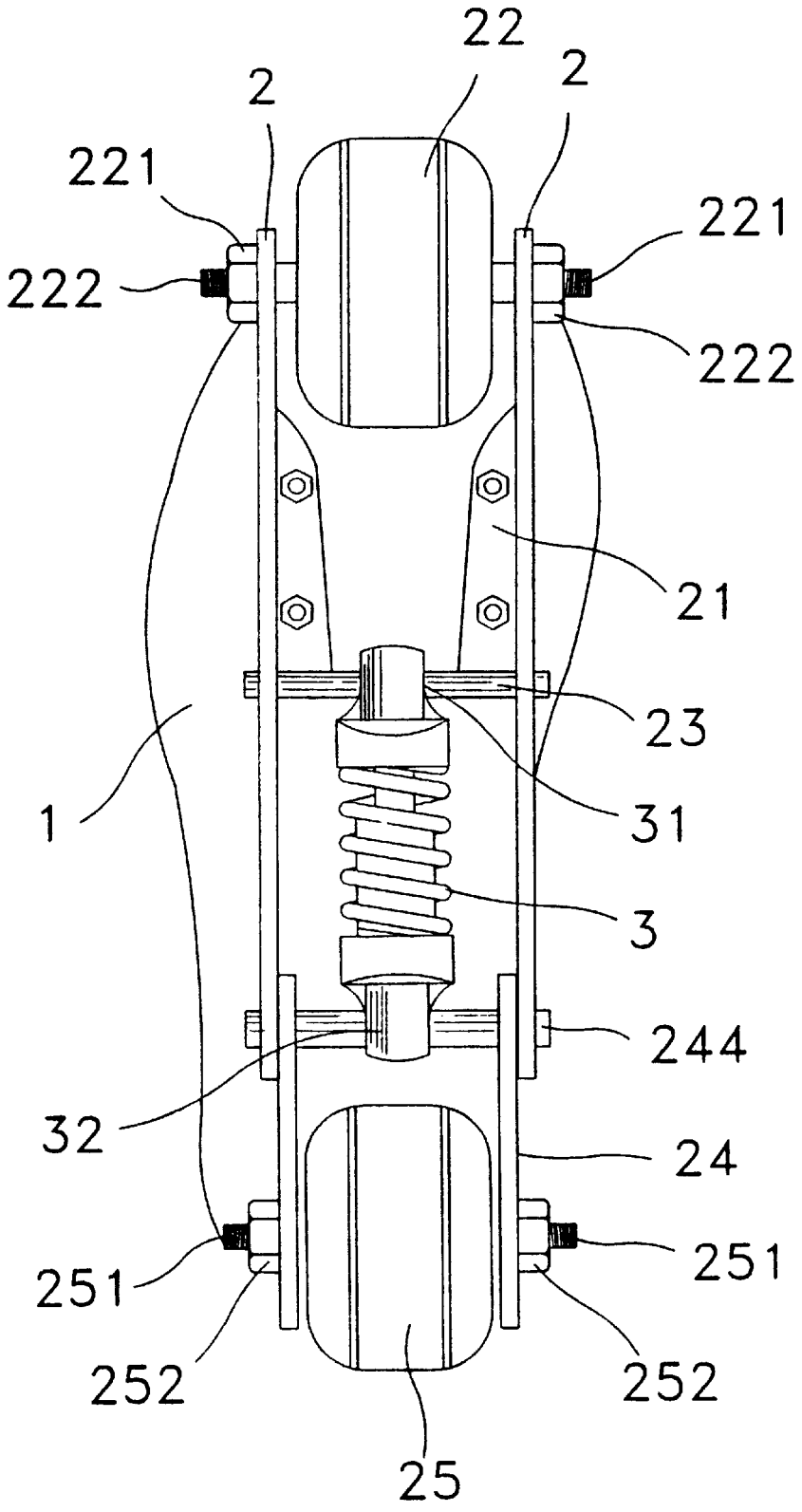
FIG. 4 is a perspective exploded view of the present invention.

Reference is made to FIGS. 2, 3, and 4. According to the sole plate of the present invention, two opposed side plates 2 are disposed at the bottom side of a boot 1. The side plates 2 each have an upper edge 21 riveted to the bottom side of the boot 1 integrally. A front wheel 22 is pivotally installed between the two side plates 2. For purpose of mounting the front wheel 22, the side plates 2 each have a through hole 20 at a projecting front end thereof for passage of a shaft 221 with threaded ends onto which nuts 222 may be fitted to secure the front wheel 22 at the front end of the side plates 2. As for the rear wheel 25, it is secured at the rear end of two movable supports 24. Each movable support 24 has a first through hole 241 at a front end thereof for receiving one end of a securing rod 243 fixedly disposed on the side plate 2. A second through hole 242 is formed above the first through hole 241 of each movable support 24 for receiving one end of a rear threaded shaft 244. The rear threaded shaft 244 is passed through a rear shaft hole 32 at a rear end of a spring 3 with nuts 2441 respectively disposed at both ends of the rear shaft hole 32. The spring 3 further has a front shaft hole 31. In order to secure the front end of the spring 3, a front threaded shaft 23 is disposed at the front portion of the side plates 2 at a suitable position, and nuts 231 are also used to position the front threaded shaft 23 in the front shaft hole 31 of the spring 3. The movable supports 24 each further have a tail through hole 240 for passage of a threaded shaft 251 which is secured in position at both ends by nuts 252. There is also provided a securing shaft 245 to reinforce the side plates 2.

Figure 5:
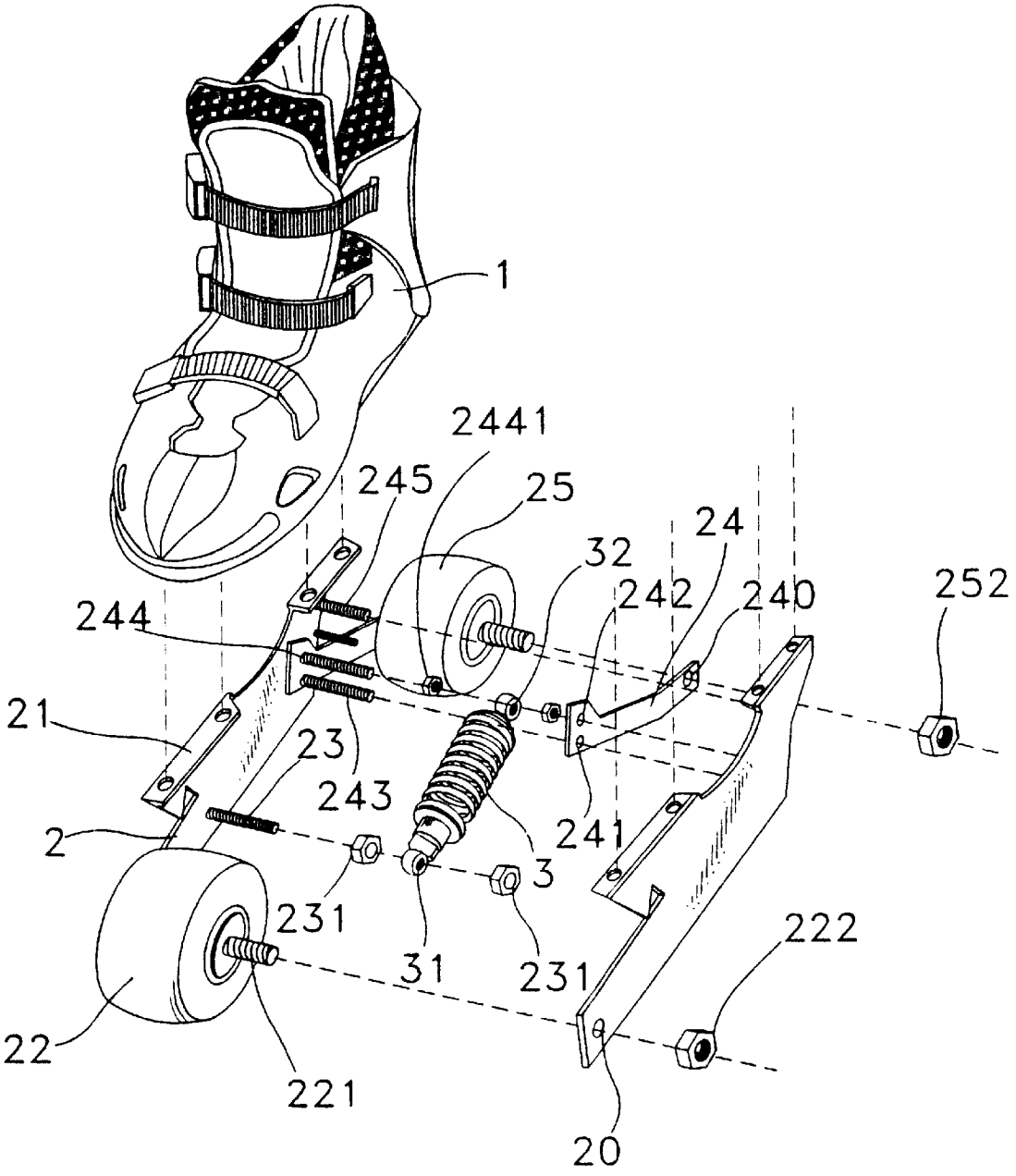
FIG. 5 is a bottom view of the present invention.

Referring to FIGS. 3 and 5, during assembly, the front wheel 22 is secured at the through holes 20 at the front ends of the side plates 2 by means of nuts 222. The rear wheel 25 is secured at the tail through holes 240 of the movable supports 24 by means of nuts 252. The movable supports 24 are in turn secured by means of the securing rod 243, which is disposed at the rear portion of the side plates 2. The rear threaded shaft 244 at the upper portion of the front end of the movable supports 24 enables the movable supports 24 to be secured to the rear shaft hole 32 of the spring 3. The front threaded shaft 23 at the front portions of the side plates 2 is provided to secure the front shaft hole 23 of the spring 3. Therefore, when the skater jumps or skates over rugged ground surface, the movable supports 24 will use the securing rod 243 as pivot and displace upwardly and downwardly upon impact, thus compressing or releasing the spring 3 to achieve shock absorbing effects.

Figure 6:
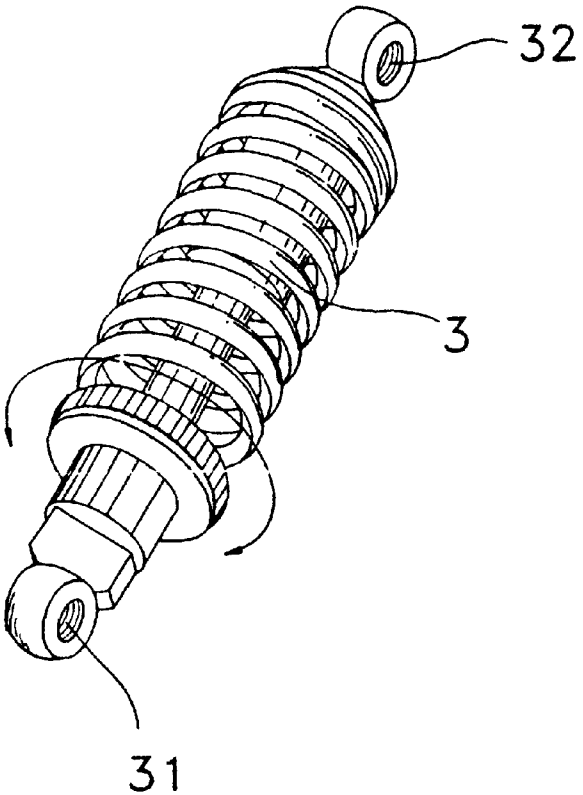
FIG. 6 is a perspective view of the spring of the present invention.
Figure 8:
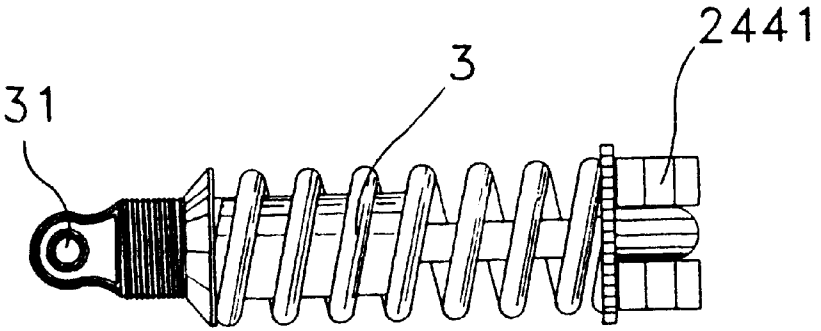
FIG. 8 is a schematic view illustrating the spring in a released state.
Figure 7:
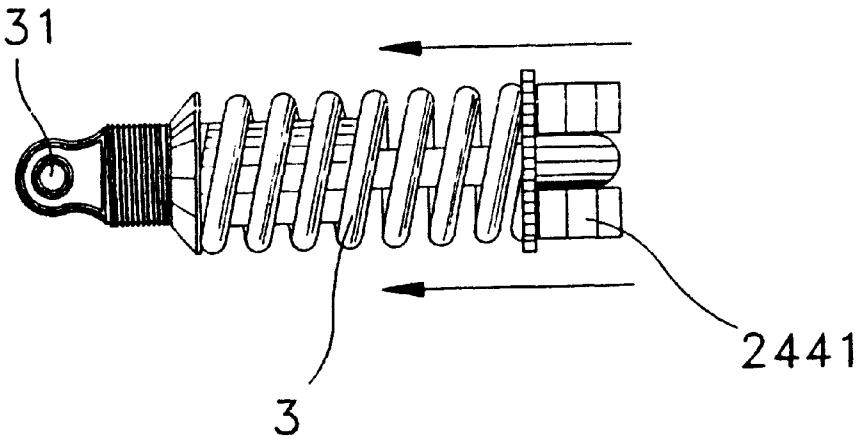
FIG. 7 is a schematic view illustrating the spring under pressure.

Referring to FIGS. 6, 7, and 8, which illustrate the action of the spring 3, since the front shaft hole 31 of the spring 3 is secured by the front threaded shaft 23, with the rear shaft hole 32 secured at the rear threaded shaft 244 at the front end of the movable supports 24, the movable supports 24 will turn with the securing rod 243 secured at the side plates 2 as pivot. Referring to FIGS. 7 and 8, the spring 3 will be compressed or released to achieve shock absorption so that the skater's ankles or feet will not get hurt. Besides, it is more comfortable to skate in a roller skate provided with a sole plate structure according to the present invention.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. A sole plate structure with shock absorbing effects for roller skates to provide roller skates with buffering resilience and to permit safe and comfortable skating, said sole plate structure comprising two opposed side plates each having an upper securing edge and being secured to a bottom side of a boot, said side plates each having a through hole at a front end thereof for securing a front wheel, wherein each of said side plates are connected by means of a securing rod, and wherein movable supports are connected at a rear end of each of said side plates by said securing rod, said movable supports having a rear wheel mounted between said movable supports at a rear end thereof, each movable support having a first through hole at a front end thereof for mounting said securing rod between said movable supports, each movable support having a second through hole at the front end thereof for mounting a rear threaded shaft which passes through a rear shaft hole of a spring, said side plates further having a front threaded shaft for insertion through a front shaft hole of said spring, whereby said spring may move upwardly and downwardly to compress or release said spring.

* * * * *